United States Patent [19]

Kullen

[11] Patent Number: 4,678,410

[45] Date of Patent: Jul. 7, 1987

[54] HAIR DRYER WITH AXIAL BLOWER

[75] Inventor: Albrecht Kullen, Wörthsee-Steinbach, Fed. Rep. of Germany

[73] Assignee: Braun Aktiengesellschaft, Kronberg, Fed. Rep. of Germany

[21] Appl. No.: 759,424

[22] Filed: Jul. 26, 1985

[30] Foreign Application Priority Data

Aug. 3, 1984 [DE] Fed. Rep. of Germany ..... 3428650

[51] Int. Cl.[4] ..... F04B 17/00; F04B 35/04

[52] U.S. Cl. ..... 417/423 R; 415/212 A; 415/213 C; 34/96

[58] Field of Search ..... 417/423 R; 34/96, 97; 219/369, 370; 415/212 A, 213 C

[56] References Cited

U.S. PATENT DOCUMENTS

| | | | |
|---|---|---|---|
| 2,108,703 | 2/1938 | Bentley | 417/423 R |
| 2,328,072 | 8/1943 | Hans | 415/213 C |
| 2,361,007 | 10/1984 | Buchanan | 417/423 R |
| 2,936,948 | 5/1960 | Eck . | |
| 3,102,679 | 9/1963 | Rudy | 417/423 R |
| 3,146,007 | 8/1964 | Boivie et al. | 415/213 C |
| 4,300,280 | 11/1981 | Majthan | 219/546 X |

*Primary Examiner*—Carlton R. Croyle
*Assistant Examiner*—Donald E. Stout

[57] ABSTRACT

A hair dryer with an axial blower is proposed, wherein the design of the blower fanwheel according to the invention increases the efficiency of air delivery so that a considerable reduction in the blower rpm and consequently the noise volume is achieved without modifying the dimensions of the appliance.

7 Claims, 3 Drawing Figures

HAIR DRYER WITH AXIAL BLOWER

The invention relates to hair-drying appliances and the like with a blower fanwheel driven by an electric motor, which blows air in the direction of its rotational axis over a heating assembly and thence to the hair to be dried. Typically, such blower fanwheel includes a hub body and blades at a constant pitch mounted thereon. As is usual in such fanwheels, these blades have an entrance angle which increases with radial distance from the rotational axis, said angle being determined as a function of the average axial flow velocity generated and the circumferential velocity of the fanwheel at the radial distance in question.

Since the drying effect of such hair dryers depends both on the temperature and the volume of air delivered per unit time, there was a tendency in the past toward more powerful heating assemblies and higher rpm blowers. However, increasing the rpm necessarily made the noise generated by such appliances more intense, something which was perceived by the user as especially irritating, because these appliances are usually operated in the immediate vicinity of the ear.

It is desirable to improve the efficiency of air delivery in a hair dryer with an axial blower in such fashion that both the blower rpm and hence the amount of noise generated would be reduced without modifying the dimensions of the appliance. Inasmuch as hair driers are appliances in daily use, which can only survive in the marketplace if they can be manufactured at attractive prices in large quantities utilizing the latest mass-production techniques, this goal had to be combined with the aim of achieving the desired improvements without additional manufacturing costs.

According to the invention, there is provided a hair dryer comprising structure defining an air inlet, an electric motor, an axial blower fanwheel mounted on the electric motor, the fanwheel consisting of a hub portion and a plurality of blades disposed on the outside circumference of the hub body, the hub body being a body of rotation, whose diameter, at least in the axial section where the blades are disposed, increases constantly in the flow direction in such fashion that its surface is curved convexly in this direction, and the blades being at constant pitch and without a profile and further having an entrance angle that increases with radial distance from the rotational axis of the hub, the angle being determined in the usual fashion as a function of the average axial flow velocity generated and the circumferential velocity of the fanwheel at the radial distance in question, and all cross sections of the blades perpendicular to the rotational axis of the fanwheel have midlines which are straight lines. In a preferred embodiment of the invention the extensions of all the midlines intersect the rotational axis of the fanwheel.

In a hair dryer of this design, the blower efficiency can be increased by the measures according to the invention to a truly remarkable extent, so that either only a fraction, for example approximately two-thirds, of the previously required rpm is needed to generate the same air throughput or a corresponding increase in the air volume delivered per unit time is possible at the same rpm. This improvement in flow technology is attributed to the meridianal acceleration of the air stream delivered, which is additionally generated and exploited by the convex shape of the lengthwise section of the hub body of the blower fanwheel according to the invention in conjunction with the shape and orientation of the fanwheel blades.

With the fanwheel blades according to the invention oriented so that all are aligned at least approximately radially to the rotational axis of the fanwheel, a fanwheel of such design can readily be manufactured in a radially divided injection mold, and a blower fanwheel with a convexly curved hub body lengthwise section is feasible in terms of injection molding technology and therefore capable of being manufactured on a mass-production basis despite the associated problems of undercutting between the blades and this hub body. In an especially advantageous embodiment of a hair dryer according to the invention, the axial blower fanwheel is mounted on the air inlet side of the electric motor and the hair dryer is equipped with a fixed follower guide wheel, known of itself, disposed in the direction of flow downstream from the fanwheel, serving to equalize the air flow generated by the fanwheel. The axial spacing between the fanwheel and this follower guide wheel is preferably 4–10 mm.

The drawing shows the subject of the invention using schematic diagrams of a hair dryer according to the invention and its blower fanwheel:

Figure 1:
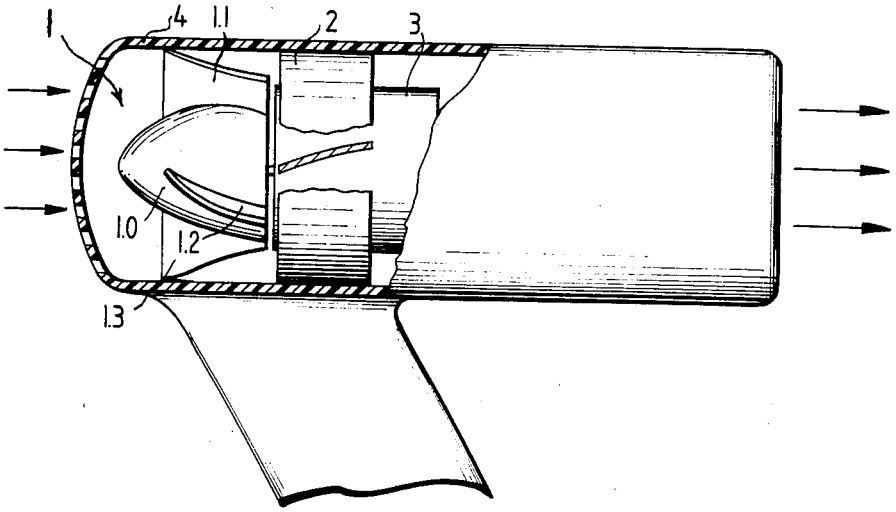
FIG. 1 shows a partially cut-away hair dryer according to the invention in a side view.

As FIG. 1 indicates, a hair dryer according to the present invention comprises an air guide channel 4, in which blower fanwheel 1 is coaxially disposed with driving electric motor 3 and the preferably employed fixed follower guide structure 2 with an array of guide vanes. Blower fanwheel 1 consists of hub body 1.0 and blades 1.1, 1.2, 1.3, and 1.4 mounted equidistantly thereon.

Figure 2:
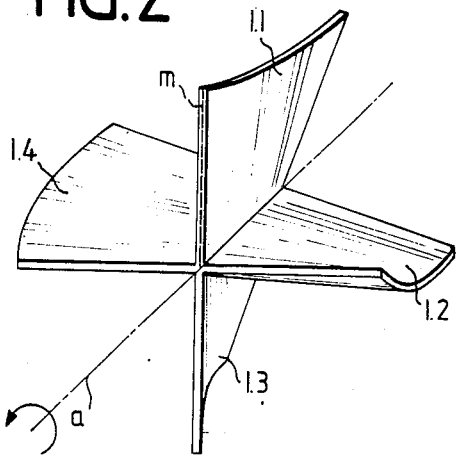
FIG. 2 shows the orientation and the arrangement of the fanwheel blades relative to the fanwheel rotational axis.
Figure 3:
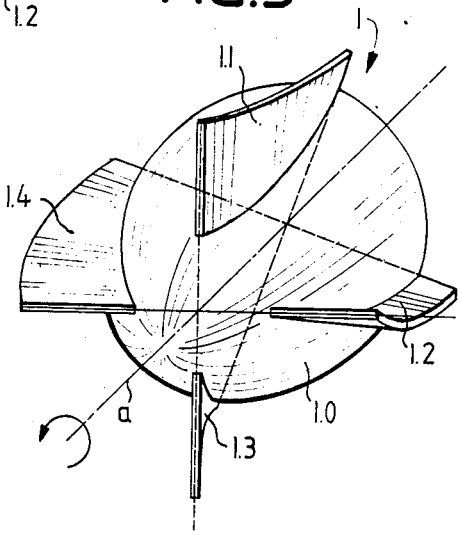
FIG. 3 shows a simple example of a complete fanwheel with the blades according to FIG. 2 and with a hub body which is convexly curved lengthwise.

In this drawing, as in FIGS. 2 and 3, the number of blades has been limited to four for reasons of clarity and simplification of the drawings. In practice, it is seven, for example.

FIG. 2 does not show a component but merely serves to explain the blade orientation. It shows a simple intersection of the blades without a hub body, from which it is apparent that any section perpendicular to rotational axis, a, through the blades produces cut surfaces whose midlines, m, are straight lines which run so that their extensions intersect rotational axis, a. (The term "midline," as is usual, is understood here to represent the connection of all points which have the same distance from the two lateral boundary lines of a cut surface.)

In FIG. 3, the intersecting blades in FIG. 2 have been supplemented by a hub body 1.0 so that a complete fanwheel 1 results, as is also shown in FIG. 1.

It has been found in practice that the hair dryers according to the present invention reduce the amount of noise generated by comparison with comparable known hair dryers, something which could not be foreseen even by an individual skilled in the art. The success which can be achieved according to the invention can be demonstrated impressively, for example, by the fact that in a hair dryer equipped with a conventionally designed blower fanwheel, i.e., one with a cylindrical hub body, by conversion according to the invention, in other words by replacing the known fanwheel by one according to the invention, the air throughput was increased in such fashion that only approximately two-thirds of the original rpm was required to achieve the original air throughput. This resulted in a reduction of the noise level by as much as 8 dB(A). Furthermore, it was found that, in addition to lowering the noise level, the entire noise spectrum was shifted toward the lower-frequency end, so that the invention is characterized not only by an objective but also by a subjective improvement in the noise characteristics of hair dryers.

An additional advantageous effect of the rpm reduction made possible according to the invention consists in the fact that the electric motor driving the fanwheel is subjected to less stress and consequently achieves a much longer lifetime.

What is claimed is:

1. A portable, hand-held hair dryer comprising structure defining an air inlet, an electric motor, an axial blower fanwheel mounted on said electric motor, said fanwheel having hub portion that is a body of rotation and a plurality of blades disposed on the outside circumference of said hub portion, the diameter of said hub portion, at least in the axial section where said blades are disposed, increasing constantly in the flow direction in such fashion that its surface is curved convexly in this direction, and said blades being smoothly curved and further having an entrance angle that increases with radial distance from the rotational axis of said hub, said angle being a function of the average axial flow velocity generated and the circumferential velocity of the fanwheel at the radial distance in question, and all cross sections of said blades perpendicular to the rotational axis of said fanwheel having midlines through the entire radial lengths of said blades, which midlines are straight lines and extensions of which intersect the rotational axis of said hub portion.

2. The dryer of claim 1 wherein said fanwheel is a one piece molded plastic member.

3. The dryer of claim 1 further including fixed vaned guide structure disposed in the flow direction downstream from said fanwheel.

4. The dryer of claim 3 wherein said guide structure is axially spaced 4–10 millimeters from said fanwheel.

5. The dryer of claim 1 wherein said axial blower fanwheel is mounted on the air inlet side on said electric motor.

6. The dryer of claim 5 further including fixed vaned guide structure axially spaced 4–10 millimeters from said fanwheel in the flow direction downstream from said fanwheel.

7. The dryer of claim 6 wherein said fanwheel is a one piece molded plastic member.

* * * * *